US005715709A

United States Patent [19]

Lai

[11] Patent Number: 5,715,709

[45] Date of Patent: Feb. 10, 1998

[54] COMBINATION LOCK CONSTRUCTION

[75] Inventor: Eric Lai, Calgary, Canada

[73] Assignee: Sunrich Company, Calgary, Canada

[21] Appl. No.: 585,112

[22] Filed: Jan. 11, 1996

[51] Int. Cl.[6] ..... E05B 37/02

[52] U.S. Cl. ..... 70/25; 70/312; 70/334; 70/52; 70/51

[58] Field of Search ..... 70/25, 22, 318, 70/333 R, 334, 27, 51, 52, 54, 312

[56] References Cited

U.S. PATENT DOCUMENTS

| | | | |
|---|---|---|---|
| 589,844 | 9/1897 | Lownes | 70/25 |
| 1,348,234 | 8/1920 | Mock et al. | 70/51 |
| 1,356,314 | 10/1920 | Sabbag | 70/25 |
| 1,522,851 | 1/1925 | Wright | 70/51 |
| 1,580,573 | 4/1926 | Schara | 70/25 |
| 3,386,271 | 6/1968 | Morin | 70/25 |
| 3,410,121 | 11/1968 | Morin | 70/25 |
| 3,720,082 | 3/1973 | Feinberg et al. | 70/25 |
| 4,444,029 | 4/1984 | Remington | 70/25 |
| 4,733,548 | 3/1988 | Ling | 70/25 |

FOREIGN PATENT DOCUMENTS

| | | | |
|---|---|---|---|
| 36073 | 4/1930 | France | 70/25 |
| 2212856 | 7/1973 | Germany | 70/25 |
| 636356 | 12/1978 | U.S.S.R. | 70/25 |
| 605018 | 7/1948 | United Kingdom | 70/25 |

*Primary Examiner*—Darnell M. Boucher
*Attorney, Agent, or Firm*—Melvin I. Stoltz

[57] ABSTRACT

By forming a plurality of false void zones in a lock housing in association with the tumbler release channel, a combination lock construction is attained which virtually eliminates the ability of trained individuals to gain unwanted access to the lock. Preferably, the combination lock housing also incorporates a plurality of non-releasing open or void zones or slots formed in association with the lock release groove for each rotatable tumbler sleeve. In this way, the desired false click is provided for each rotatable dial in order to thwart unwanted opening of the combination lock of this invention. Furthermore, the lock construction of the present invention is constructed with the interior chambers thereof virtually sealed from ambient surroundings, thereby preventing unwanted contamination from entering the interior of the lock and the rotating components thereof. In this way, degradation by contamination is virtually eliminated. Finally, the present invention preferably employs a minimum number of components in combination with a housing and a movable shackle in order to provide the desired, unique combination lock construction of this invention. As a result, a cost effective, high quality combination lock is attained.

19 Claims, 5 Drawing Sheets

COMBINATION LOCK CONSTRUCTION

TECHNICAL FIELD

This invention relates to combination locks, and, more particularly, to combination locks constructed to virtually eliminate the ability of any unauthorized person to "pick" the lock.

BACKGROUND ART

Numerous lock constructions have been developed and are widely employed by individuals to prevent unauthorized persons from gaining access to any area which has been closed and locked. Although many locks are constructed to be opened by a key, numerous combination locks have been developed which are opened by knowledge of a particular combination.

One particular type of combination lock that has become very popular due to its ease and convenience of use is a combination lock which employs a plurality of rotatable independent dials, each of which forms one of the indicia, usually numerals or letters, comprising the combination for releasing the lock. Although locks of this general nature have been available for several decades, these prior art combination lock constructions suffer from common deficiencies which have not been successfully overcome.

Although many manufacturers have attempted to solve the problems associated with rotatable dial or combination locks, these prior art constructions have been unable to produce a construction which substantially eliminates the ability of unauthorized persons discovering the combination for opening the lock. Although numerous attempts have been made in prior art constructions for achieving a system which would eliminate or prevent unauthorized opening or picking of a lock, these prior art constructions have failed to provide the desired results.

Another common problem which has consistently plagued prior art constructions is the cost of construction for producing and assembling prior art combination locks. In order to attain a combination lock which provides all of the features desired by consumers, prior art constructions typically incorporate numerous small components, each of which require expensive assembly procedures to produce the final product. As a result, these prior art lock constructions typically are expensive to produce, thereby reducing the ability of these locks to reach a broad base of consumers.

Another problem commonly found with prior art combination locks is the inability of these prior art constructions to prevent contaminants from reaching the rotatable, internal components of the lock, thereby causing damage to these components or interfering with the ease of operating the lock by an individual knowing the actual combination. Although numerous attempts have been made to reduce the adverse effects caused by contaminants reaching these components, such attempts have been incapable of satisfactorily eliminating this problem.

Therefore, it is a principal object of the present invention to provide a combination lock construction which virtually eliminates the ability of unauthorized persons from gaining access to the lock by attempting to pick the lock using known techniques.

Another object of the present invention is to provide a combination lock having the characteristic features described above which employs a minimum of components and is quickly and easily assembled, thereby providing a lock capable of being constructed at a competitive price.

Another object of the present invention is to provide a combination lock construction having the characteristic features described above which effectively seals the rotating components from external contamination and effectively prevents any external contaminants from reaching the rotating components thereof.

Other and more specific objects will in part be obvious and will in part appear hereinafter.

SUMMARY OF THE INVENTION

By employing the present invention, all of the difficulties and drawbacks of the prior art constructions are virtually eliminated and an effective, easily produced, combination lock is achieved which is capable of virtually eliminating the ability of unauthorized persons from opening the lock, using known picking techniques. Furthermore, the lock construction of the present invention is constructed with the interior chambers thereof virtually sealed from ambient surroundings, thereby preventing unwanted contamination from entering the interior of the lock and the rotating components thereof. In this way, the prior art degradation and interference of the lock operation by contamination is virtually eliminated.

In accordance with the present invention, a minimum number of components are employed in combination with a housing and a movable shackle in order to provide the desired, unique combination lock construction of this invention. In general, in addition to the shackle and housing, only a plurality of rotating dials and a plurality of tumbler sleeves are required to provide the desired locking mechanism. Preferably, in order to assure user security that a locked item remains locked and incapable of access by unauthorized personnel, four dials and tumbler sleeves are employed with the housing.

As is well known in the lock industry, individuals seeking to pick or open a lock without knowledge of the combination use the audible sound produced by the tumbler entering the open chamber when properly aligned therewith. By rotating a dial and listening for the sound produced when the proper position is reached, such trained individuals are capable of determining the requisite position for each tumbler, without knowledge of the actual combination.

In the present invention, the ability of unauthorized persons to determine the actual combination using the sound is thwarted by incorporating in the housing a plurality of false void zones having a construction similar to the actual open chamber or open zone which provides the lock release for each tumbler. By providing a plurality of false void zones as part of the lock construction, the ability of trained individuals to pick the lock is virtually eliminated.

In the preferred construction, the central housing of the combination lock of this invention incorporates an elongated lock release groove or slot which provides the lock release zone for each of the independent rotatable tumbler sleeves. In addition, the housing also incorporates a plurality of non-releasing open zones or slots formed in association with the lock release groove for each rotatable tumbler sleeve. In this way, the desired false click is provided for each rotatable dial in order to thwart unwanted opening of the combination lock of this invention.

In addition, in the preferred construction, all of the rotatable components are mounted in a single elongated bore formed in the housing and a sealing cap is employed to effectively close and seal the elongated bore once the components are mounted therein. As a result, ease of assembly is attained and, once assembly is completed, the elongated bore and the rotational components positioned therein are effectively sealed from external contamination. As a result, dirt, dust, debris, etc., commonly present in the environment, is eliminated from contaminating the working components of the combination lock of this invention. In this way, contamination from environmental sources which has often caused prior art lock assemblies to become defective or injured is effectively overcome.

In addition to these features, the present invention achieves a combination lock using a minimum number of independent components each of which is capable of being quickly assembled into the final product. As a result, a construction is attained which is capable of being manufactured at a competitive price, while providing a high quality, highly effective combination lock which prevents exposure to environmental contamination and also incorporates means for virtually eliminating unauthorized persons from opening the lock without knowledge of the combination.

The invention accordingly comprises an article of manufacture possessing the features, properties, and the relation of elements which will be exemplified in the article hereinafter described and the scope of the invention will be indicated in the claims.

THE DRAWINGS

For a fuller understanding of the nature and objects of the invention, reference should be had to the following detailed description taken in connection with the accompanying drawings, in which.

DETAILED DESCRIPTION

Figure 1:
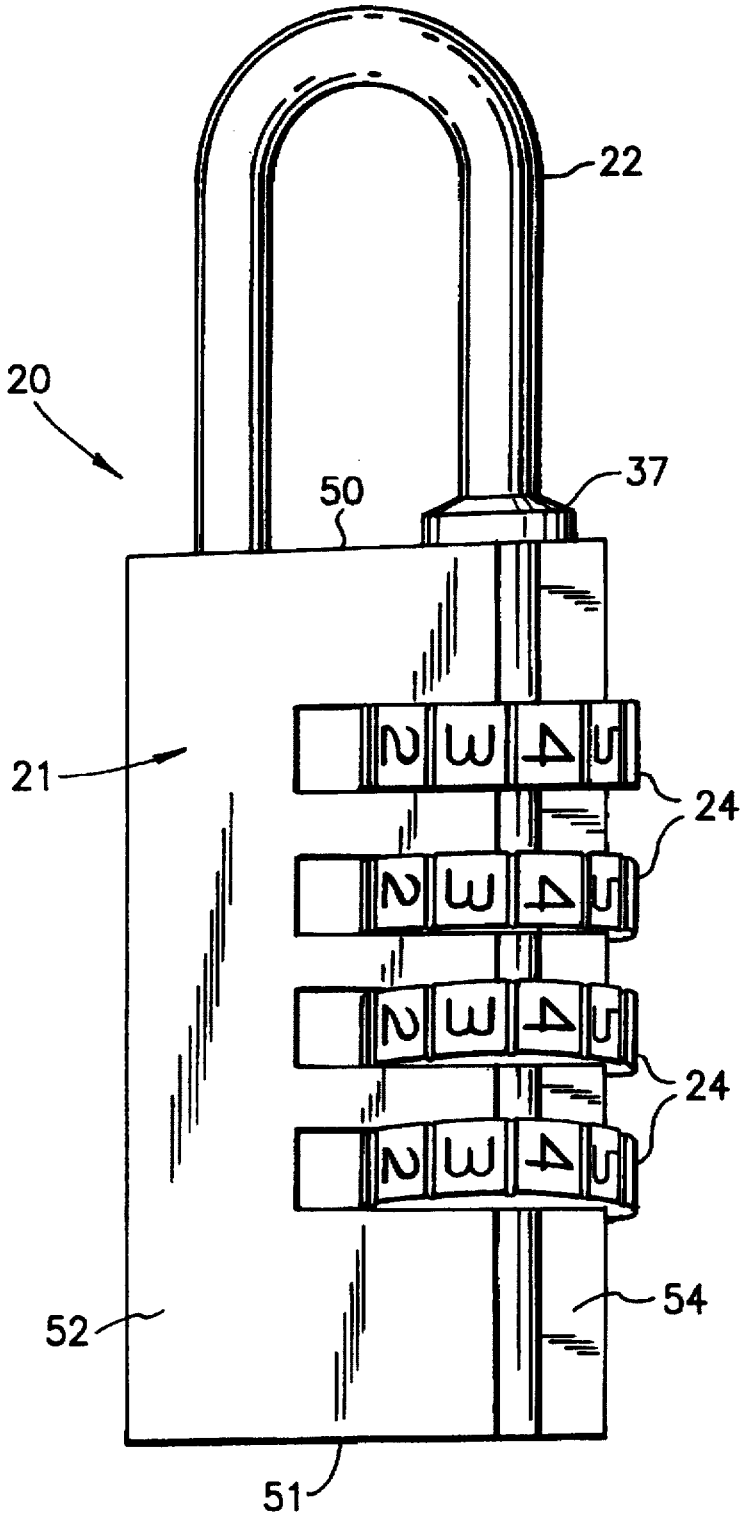
FIG. 1 is a perspective view of the combination lock of the present invention shown fully assembled and in the locked position.

By referring to FIGS. 1–9, along with the following detailed disclosure, the construction and operation of combination lock 20 of the present invention can best be understood. In the drawings and the following detailed disclosure, the preferred embodiment of the present invention is fully disclosed. However, the present invention can be implemented using alternate constructions, which alternate constructions are intended to be within the scope of the present invention.

As shown in FIGS. 1–9, combination lock 20 of the present invention is constructed using a minimum of principal components, thereby substantially reducing the complexity found in most prior art combination locks. In this way, the present invention provides a highly effective, commercially desirable construction capable of being produced at a competitive cost, while still providing all of the locking and theft deterrent features typically incorporated in prior art combination locks.

In the present invention, the principal components comprise a central housing 21, a shackle 22, four separate and independent tumbler sleeve 23, and four separate and independent rotatable dials 24. By employing these principal components, in the unique manner detailed herein, an easily produced, highly effective combination lock 20 is attained.

Each tumbler sleeve 23 comprises a generally cylindrical shape incorporating a single locking fin 25 radially extending from outer, circular-shaped surface 26. In addition, each tumbler sleeve 23 also comprises an inside, circular-shaped surface 27 which is coaxially aligned with outside surface 26. The diameter of inside surface 27 of tumbler sleeve 23 is constructed to enable each tumbler sleeve 23 to freely pivot about the outer surface of shackle 22.

Each dial 24 is constructed for peripherally surrounding and cooperating with a tumbler sleeve 23. In this regard, each dial 24 comprises two separate and distinct, circular-shaped inside surfaces 28 and 29. In side surface 28 comprises a diameter slightly greater than the diameter of outside surface 26 of tumbler sleeve 23, in order to enable tumbler sleeve 23 and dial 24 to cooperate with each other while being independently rotationally movable about shackle 22.

In addition, each dial 24 comprises a plurality of slots 30 formed in inside surface 28, with each slot being constructed for receiving and retaining radially extending fin 25 of tumbler sleeve 23. In this way, whenever radially extending fin 25 is mounted in a slot 30 of dial 24, tumbler sleeve 23 and dial 24 are in interlocked engagement, causing both members to rotate together about shackle 22.

The number of slots 30 formed in dial 24 corresponds to the number of separate and distinct indicia formed on the outer surface of dial 24. In the preferred embodiment, ten indicia are employed on the outside surface of dial 24 and ten slots 30 are formed in surface 38.

Inside surface 29 of dial 24 comprises a circular shape formed by a diameter which is aligned with the axis of surface 28, but is greater than the length of fin 25. In this way, when fin 25 is disengaged from slot 30 of dial 24, dial 24 is able to rotate about shackle 22 independently of tumbler sleeve 23.

Shackle 22 comprises a conventional J-shape incorporating a short leg 31 with a terminating end 32 and a long leg 33 with a terminating end 34. Each tumbler sleeve 23 is rotationally mounted to leg 33 of shackle 22, with each tumbler sleeve having a dial 24 rotationally associated therewith.

As discussed above, each dial 24 has a plurality of indicia formed on the outer peripheral surface thereof, each of which represents one component of the combination for positioning tumbler sleeves 23 in the requisite location for releasing shackle 22. Although any desired indicia can be employed, numerals or letters are typically employed on prior art constructions. In the present invention, each dial 24 comprises an outer surface 44 on which ten panels 45 are formed with slots 46 separating each panel 45. In addition, one numeral ranging from 0, 1, 2, 3, 4, 5, 6, 7, 8 and 9 is formed on each panel 45. The numeral in each panel 45 of each dial 24 is then employed to define the combination for lock 20.

The remaining components employed to form combination lock 20 of the present invention comprise washer 35, split locking ring 36, sealing cap 37, and spacer 43. In the preferred construction, leg 33 of shackle 22 incorporates ribs 38 and 39 formed on the outer surface thereof and a locking ring receiving slot 40 formed near terminating end of shackle 22.

Figure 2:
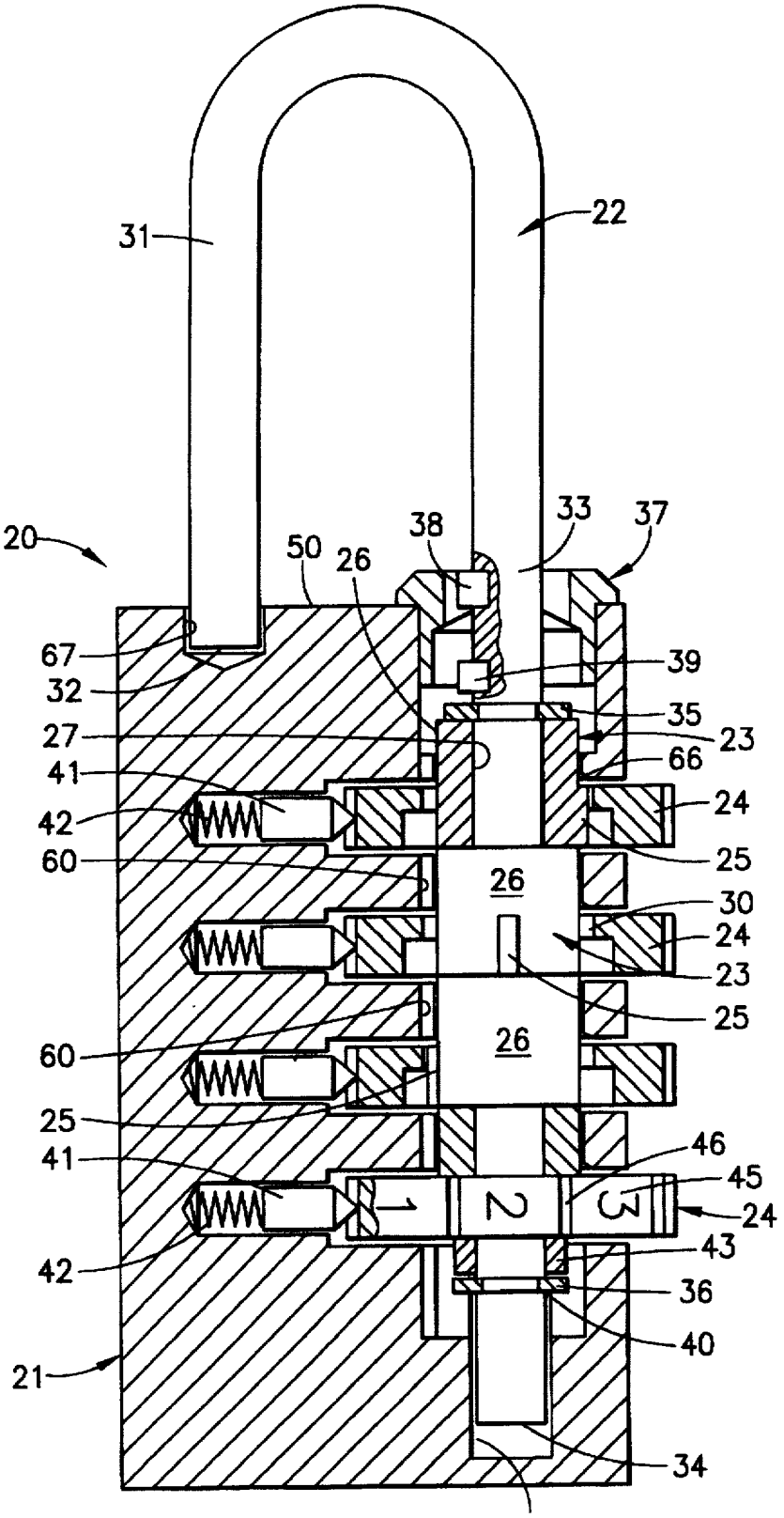
FIG. 2 is a front elevational view, partially in cross section, depicting the fully assembled combination lock of the present invention in its normal operating and locked position.
Figure 7:
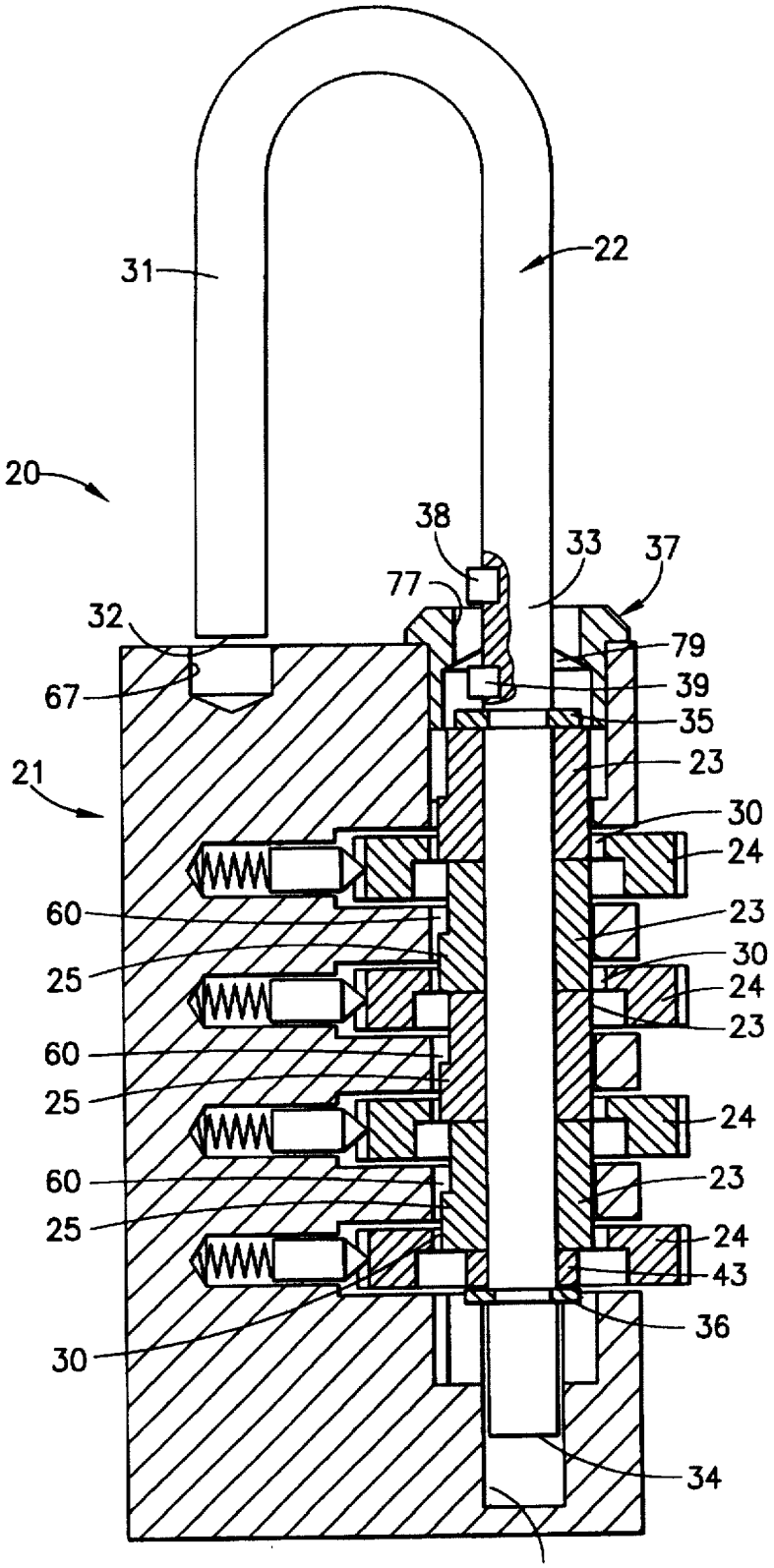
FIG. 7 is a front elevation view, mostly in cross-section, depicting the combination lock of the present invention in its unlocked configuration.
Figure 8:
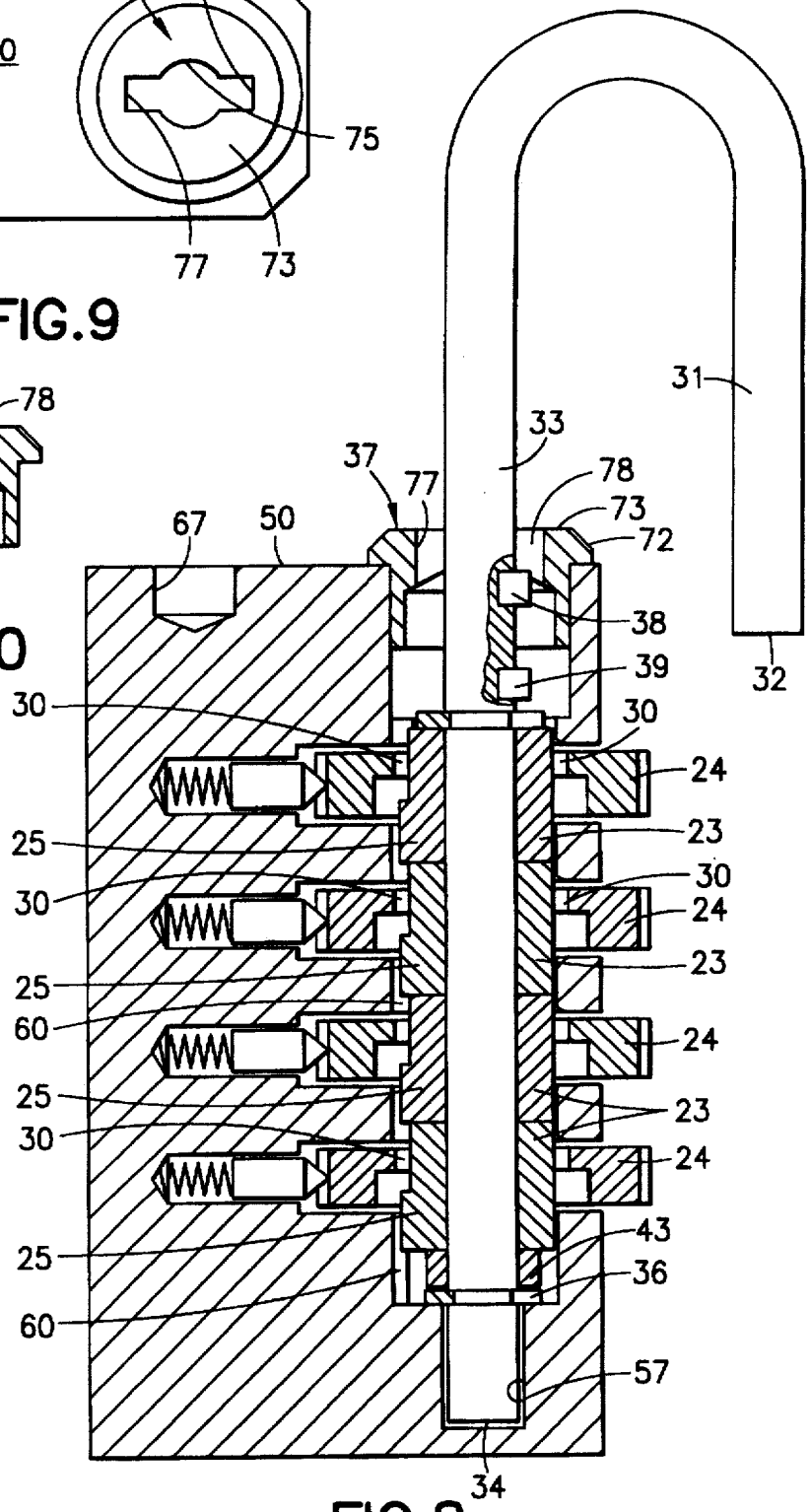
FIG. 8 is a cross-sectional from elevational view of the combination lock of the present invention, mostly in cross-section, depicting the combination lock of the present invention in its combination changing configuration.

As clearly depicted in FIGS. 2, 7 and 8, the axial distance between rib 39 and slot 40 is constructed for being substantially equivalent to the axial length required for enabling locking ring 36, when mounted in slot 40, to retain the four tumbler sleeves 23 and spacer 43 on leg 33 of shackle 22, with each tumbler sleeve 23 being capable of independent rotational movement, while substantially eliminating any axial movement thereof. In this way, tumbler sleeves 23 are able to provide the desired locking and unlocking function, while achieving this result in an easily manufactured and easily assembled construction.

The final components incorporated into combination lock 20 of the present invention comprise a plurality of sets of pins 41 and springs 42, which are mounted in a receiving cavity formed in housing 21. Although these components are optional, the preferred embodiment incorporates one pin and spring in direct association with each rotatable dial 24 in order to provide positive position locating means which also produces an audible sound each time the precise position of each numeral on dial 24 is reached.

In the preferred construction, each spring 42 is maintained under compression, forcing each pin 41 into engagement with outer surface 44 of dial member 24. In addition, with each dial member incorporating slots 46 formed between each numeral bearing panel 45, the movement of spring loaded pin 41 into and out of slots 46 causes an audible click, designating the proper orientation of the dial for each numeral. In addition to the audible click produced, the movement of pin 41 into engagement in slot 46 also provides a positive structural indication and rotational stop indicating that one particular numeral is in its proper orientation.

As shown in FIG. 1, a visual indicator of the proper orientation for each numeral of each panel 45 of each dial 24 is also provided by incorporating on housing 21 a position orientating line 47. Line 47 enables the user to visually position each numeral in the proper location for a pre-set combination. By employing orientation line 47 along with pins 41 and springs 42, proper orientation of any particular numeral is easily achieved.

Figure 5:
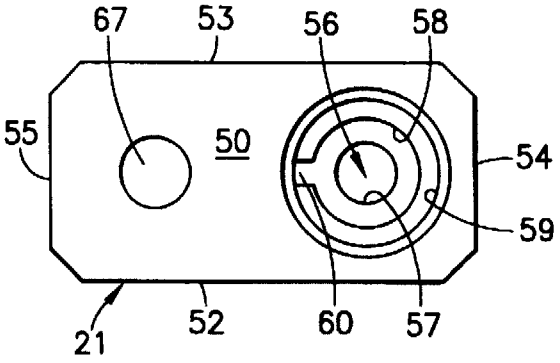
FIG. 5 is a top plan view of the housing of FIG. 4.
Figure 6:
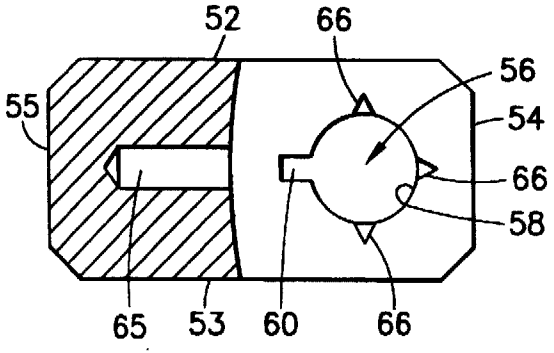
FIG. 6 is a cross-sectional plan view depicting a typical upper surface of each dial receiving zone of the housing of FIG. 4.
Figure 4:
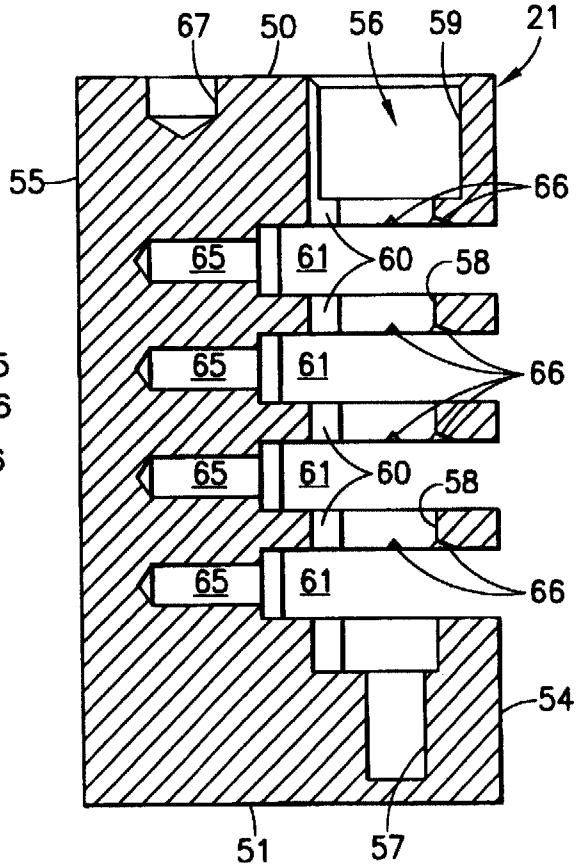
FIG. 4 is a cross-sectional front elevation view of the housing of the present invention.
Figure 3:
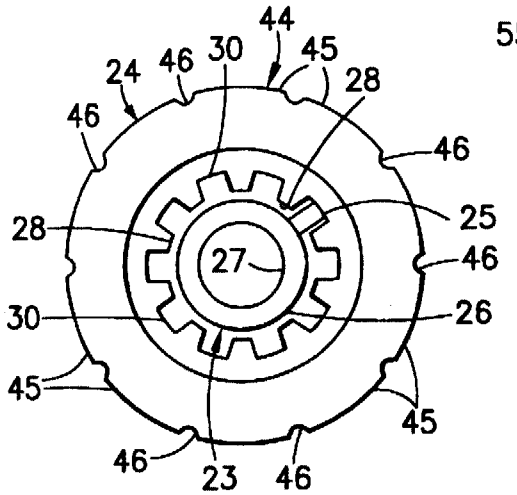
FIG. 3 is a bottom plan view of one rotating dial with one rotatable tumbler sleeve interengaged therewith.

One of the principal components of combination lock 20 comprises housing 21, which is clearly depicted in FIGS. 4–6. As shown therein, housing 21 comprises a single piece construction, within which various cavities, bores, and receiving zones are formed. In general, housing 21 comprises a top surface 50, a bottom surface 51, a front panel 52, a rear panel 53, and two side panels 54 and 55.

In addition, housing 21 also incorporates a central, elongated bore 56 extending from top surface 50 almost to bottom surface 51 which comprises three separate diameters, forming three separate and independent coaxial zones 57, 58, and 59. Zone 57 comprises the lowermost zone of bore 56 and comprises a diameter slightly greater than the diameter of shackle 22. In this way, leg 33 of shackle 22 is capable of moving into and out of interengagement with zone 57, while preventing any other components mounted to leg 33 of shackle 22 from entering zone 57.

Zone 58 comprises the intermediate zone of bore 56 and has a diameter slightly greater than the outside diameter of tumbler sleeves 23. In this way, tumbler sleeves 23 are capable of axial movement through zone 58 of central bore 56. In addition, zone 58 also comprises an elongated slot or channel 60 formed along one wall of zone 58, providing the release position for each radially extending fin 25 of each tumbler sleeve 23. As is more fully detailed below, when each locking fin of each tumbler sleeve 23 is aligned with release channel 60, shackle 22 is capable of axial movement, thereby enabling shackle 22 to be removed from its locked position or, if desired, inserted into its locked position, or axially advanced into zone 57 of bore 56 of housing 21, to enable the combination to be changed.

The final zone of bore 56 is upper zone 59 which comprises the largest diameter of bore 56. Generally, the diameter of zone 59 is constructed to enable each tumbler sleeve 23 with its radially extending fin 25 to be easily advanced through zone 59. In this way, assembly of combination lock 20 is easily attained.

In addition, upper zone 59 is constructed for receiving and securely retaining sealing cap 37. In its preferred construction, sealing cap 37 comprises a cylindrical shape formed by outer surface 70 and upper flange 71. Preferably, the diameter of zone 59 is substantially equivalent to the diameter of outer surface 70 of cap 37 in order to require cap 37 to be forced into zone 59 and, once inserted therein, securely affixed thereto.

In the preferred construction, washer 35, tumbler sleeves 24, spacer 43, and locking ring 36 are mounted to leg 33 of shackle 22. Then, when dials 24 are mounted in place, the fully assembled leg 33 of shackle 22 is inserted into bore 56 of housing 21. The assembly is then completed for forcing sealing cap 37 into zone 59 of bore 56 until the entire outer surface 70 of cap 37 is fully engaged in zone 59 and peripheral flange 71 contacts top surface 50 of housing 21.

With sealing cap 37 securely, integrally fastened to housing 21, tumbler sleeves 24 are protected from interference from environmental debris. Since bore 56 is effectively sealed from the ambient surroundings, the entry of unwanted dirt and/or debris into bore 56 is effectively prevented. As a result, long-term, trouble-free operation of combination lock 20 is provided.

In order to assure that each dial 24 is cooperatively associated with a tumbler sleeve 23 and is rotatable about leg 33 of shackle 22 along with its associated tumbler sleeve, housing 21 incorporates four separate and independent dial receiving zones 61. Each dial receiving zone 61 is formed in juxtaposed spaced aligned parallel relationship with each other, while also being cooperatively associated with zone 58 of central bore 56 and elongated release channel 60. In addition, each dial receiving zone 61 is defined by an upper surface 62 and a lower surface 63 which are parallel to each other. Furthermore, each dial receiving zone 61 is cooperatively associated with a cavity 65, within which spring 42 and pin 41 are positioned for interengagement with dial 24.

As discussed above, one of the difficulties encountered with prior art combination locks is the ability of some individuals to gain access to a secured lock by using known picking techniques. The principal technique employed is to apply pressure to the shackle while individually rotating the dials and listening for a known clicking sound which occurs whenever the locking fin or bar of the tumbler sleeve enters the release channel associated with that tumbler. By continuously repeating this process, a secured lock is capable of being unlocked even though the individual does not know the actual combination for that lock.

In order to virtually eliminate the ability of the combination lock of the present invention to be picked, housing 21 incorporates a plurality of recess slots 66 formed about elongated central bore 56 in an arcuate, juxtaposed, spaced relationship relative to release channel 60. In the preferred embodiment, three recess slots 66 are formed about zone 58 of central bore 56 at approximately 90° from each other on each wall 62 of each dial receiving zone 61.

In this way, each dial and each tumbler sleeve is directly associated with three separate and independent recess slots 66 in order to assure that false clicking of position locating sounds are produced whenever each dial is rotated. As best seen by the uppermost tumbler sleeve 23 and dial 24 of FIG. 2, when lock 20 is in its secured and locked position, the rotation of dial 24 about leg 33 of shackle 22 also causes tumbler sleeve 23 to rotate, since fin 25 is captured in one slot 30 of dial 24. If an unauthorized person attempts to pick combination lock 20, seeking to hear the clicking sound made when each fin 25 enters release channel 60, the individual will be thwarted, since a plurality of false clicks will be produced for each tumbler sleeve 23 and dial 24.

In the present invention, whenever tumbler sleeve 23 and dial 24 are rotated with axial pressure placed on shackle 22 to pick lock 20, fin 25 rotationally moves along upper surface 62 of dial receiving slot 61 until fin 25 enters one of the slots 66 formed in surface 62. Upon entering a slot 66, a clicking noise is produced which simulates the noise produced when fin 25 enters release channel 60.

Since three separate recess slots 66 are formed on each surface 62 of each dial receiving slot 61 (FIG. 6), each tumbler sleeve/dial combination produces four clicks, only one of which represents the actual entry of fin 25 into channel 60. As a result, the easy and quick picking procedure attainable with most prior art constructions is eliminated, and a virtually pick-free structure is realized.

The final aperture formed in housing 21 is shackle receiving hole 67 formed in top surface 50 of housing 21 in juxtaposed, spaced, parallel aligned relationship with central bore 56. Hole 67 is constructed for receiving terminating end 32 of leg 31 of shackle 22, providing the desired receiving holding zone for terminating end 32 whenever combination lock 22 is in its secured and locked position. As with conventional constructions, hole 67 is constructed with a diameter slightly greater than the diameter of leg 31 of shackle 22 in order to assure ease of insertion and withdrawal of leg 31 with hole 67.

By referring to FIGS. 7–10, along with the following detailed disclosure, the unlocking and combination resetting functions of combination lock 20 of the present invention can best be understood. In FIG. 7, combination lock 20 is depicted in its unlocked position. In order to attain the unlocked position, each dial 24 must be rotated to the precise location wherein radially extending fin 25 of each tumbler sleeve 23 is aligned with release channel 60. Once each radially extending fin 25 is positioned within release channel 60, leg 43 of shackle 22 is capable of being axially raised upwardly, removing terminating end 32 of leg 31 from the secure locked interengagement within hole 67.

As shown in FIG. 7, when leg 43 of shackle 22 has been axially raised upwardly, removing leg 31 from retained interengagement with hole 67 of housing 21, each radially extending fin 25 of each tumbler sleeve 23 enters a portion of release channel 60 of housing 21. Since release channel 60 is constructed with dimensions which are slightly greater than radially extending fin 25, fin 25 of each tumbler sleeve 23 is able to easily enter channel 60, but any rotational movement of tumbler sleeve 23 or dial 24 is prevented, since each tumbler sleeve 23 is effectively locked in channel 60.

Although tumblers sleeves 23 and dials 24 are incapable of rotational movement, once leg 31 of shackle 22 is removed from hole 67, shackle 22 is capable of rotational movement about the axis defined by leg 33. However, the longitudinal axial movement of leg 33 of shackle 22 is controlled by the construction of sealing cap 37.

Figure 9:
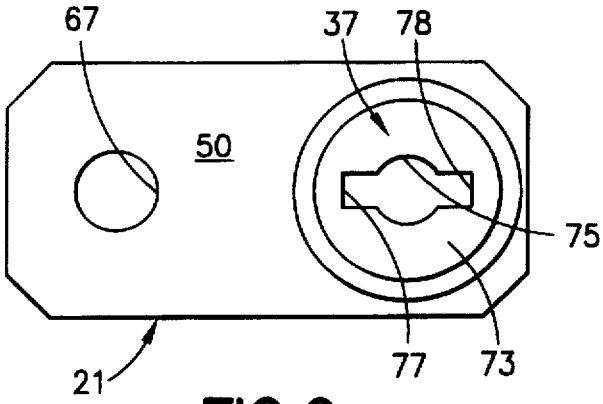
FIG. 9 is a top plan view of the fully assembled housing of FIG. 7 shown with the shackle removed.
Figure 10:
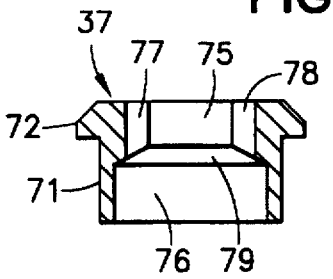
FIG. 10 is a cross-sectional elevation view of the sealing cap of the combination lock of the present invention.

As shown in FIGS. 9 and 10, sealing cap 37 is preferably constructed with a top surface 73 and 75 and 76 defining two separate and distinct substantially circular shaped inside surfaces of cap 37. Surface 75 defines a substantially circular shaped portal having a diameter slightly greater than the diameter of shackle 22. In this way, shackle 22 is freely movable in portal 75 both axially and rotationally, while also cooperating with the diameter of shackle 22 to prevent unwanted debris from entering therebetween.

In addition to portal 75, top surface 73 of sealing cap 37 also incorporates two diametrically opposed radially extending keyway slots 77 and 78 formed therein and cooperating with portal 75. Keyway slots 77 and 78 are constructed for cooperating with ribs 38 and 39 of shackle 22, in order to control the axial movement of shackle 22.

As a result of this construction, sealing cap 37 incorporates two juxtaposed, spaced, facing, inwardly extending, radial ledges 79 formed on opposed sides of aperture 75 and keyway slots 77 and 78. By employing this construction, top surface 73 and radially extending ledges 79 cooperate with ribs 38 and 39 of shackle 22 to control the axial movement of shackle 22 relative to housing 21.

As shown in FIG. 7, when combination lock 20 is in the open position, with leg 31 removed from hole 67, rib 38 is disengaged from keyway slot 77, thereby allowing shackle 22 to pivot about the central axis of leg 33. Furthermore, in this construction, washer 35 comprises an outer diameter which is less than the diameter of inside surface 76, thereby enabling washer 35 to enter the interior zone defined by inside surface 76. However, outside surface 26 of tumbler sleeve 23 is constructed with a diameter which is greater than the diameter of inside surface 76 of cap 37. As a result, the axial advance of shackle 22 upwardly is limited by the contact of the uppermost tumbler sleeve 23 with the base of sealing cap 37.

These dimensions are controlled in Order to assure that rib 39 may contact radially extending ledge 79, but is incapable of entering keyway slots 77 or 78. As a result, the free rotational movement of shackle 22 is attained. In this way, a user is able to mount leg 31 of shackle 22 with any desired object for securely closing and effectively locking the object once leg 22 has been pivoted back to aligned relationship with hole 67 of housing 21.

When shackle 22 is released from engagement with hole 67, shackle 22 is capable of pivoting about the axis defined by leg 33, but is incapable of axially advancing into engagement with bore 56 due to the contact of rib 38 with top surface 73 of cap 37. The only positions in which shackle 22 is capable of axial movement is when rib 38 is aligned with keyway slot 77 or keyway slot 78. As is evident from the foregoing detailed disclosure, whenever rib 38 is aligned with keyway slot 77, shackle 22 is capable of being moved into its locked position. However, further axial advance of shackle 22 relative to housing 21 is prevented since the terminating end 32 of leg 31 engages receiving hole 67, preventing any further axial movement of shackle 22. However, as shown in FIG. 8, whenever shackle 22 is pivoted 180° from its locked position, bringing rib 38 into alignment with keyway slot 78, shackle 22 can be axially advanced into engagement with housing 21 until terminating end 34 of leg 33 of shackle 22 contacts the base of zone 57 of bore 56 or spacer 43 contacts the top of zone 57.

When shackle 22 is advanced into this position, with terminating end 34 contacting the base of zone 57 or washer 43 contacts the entry of zone 57, rib 38 passes through slot 78, enabling shackle 22 to arcuately pivot relative to housing 21. However, the removal of shackle 22 from any arcuate position is prevented due to the contact of rib 38 with ledge 79. The only position within which shackle 22 can be removed from this position is when rib 38 is aligned with keyway slot 78.

As clearly shown in FIG. 8 in addition to end 34 of shackle 22 being in contact with the base of zone 57 or washer 43 being in contact with the entry of zone 57, tumbler sleeves 23 are advanced into housing 21 into a position wherein each radially extending fin 25 of each tumbler sleeve 23 is securely mounted in channel 60 of housing 21. In addition, radially extending fins 25 of each tumbler sleeve 23 is lowered into a position whereby each radially extending fin 25 is disengaged from slot 30 of each dial 24. As a result, although tumbler sleeves 23 are incapable of being rotationally moved, due to the secure interengagement of fin 25 with slot 60, each dial 24 is free to rotate about the axis defined by shackle 22 since fin 25 has been completely disengaged from each dial 24. In this way, any desired numeral can be aligned with position orientation line 47, thereby enabling the user to select any desired combination of numbers to represent the particular combination for opening lock 20.

Once dials 24 have been arranged into the numeral sequence desired by the user to form the opening combination for lock 20, shackle 22 is pivoted to the position wherein rib 38 is aligned with keyway slot 78 and shackle 22 is axially raised upwardly until rib 38 exits slot 78. Once in this raised position, shackle 22 is capable of being freely pivoted about its central axis with leg 31 being engaged with the desired item to be locked and then pivoted into aligned relationship with hole 67 for securing combination lock 20 in the precisely desired location.

As is evident from the foregoing detailed disclosure, by employing the present invention, a uniquely constructed combination lock is attained which provides all of the desired functions of a combination lock in a highly effective, easily assembled and easily employed construction capable of being produced with substantially greater ease and convenience. Furthermore, the construction of the present invention incorporates a plurality of means for producing a false click, thereby effectively attaining a combination lock which virtually eliminates unauthorized individuals from gaining access to the combination lock, when in its locked position, using conventional picking techniques.

Furthermore, the combination lock of the present invention incorporates a virtually sealed construction which eliminates unwanted debris from entering the rotating mechanisms of the combination lock. As a result, interference of these rotating components with environmental debris is virtually eliminated and a combination lock is attained which is capable of providing long-term use, free from interference or destruction by environmental contamination.

In addition to employing the present construction detailed above, the present invention can also be implemented using alternate design features. One such feature easily employed in the present invention without deviating from the scope of the present invention would be the elimination of rib 39 and the incorporation of a radially extending ledge in leg 33 of shackle 22 to define the stop position for washer 35. In addition, washer 35 may comprise a ledge or diameter so as to prevent the entry of washer into the cavity formed by inside surface 76 of cap 37. In this way, the axial movement of shackle 22 upwardly would be limited by the contact of washer 35 with the base of cap 37.

These variations, as well as other variations, can be incorporated into combination lock 20 of the present invention without departing from the scope of the present invention. Consequently, it is intended that all such variations form a part of this invention and are within the scope of this invention.

It will thus be seen that the objects set forth above, among those made apparent from the preceding description are efficiently attained and, since certain changes may be made in the above article without departing from the scope of this invention, it is intended that all matter contained in this disclosure or shown in the accompanying drawings, shall be interpreted as illustrative and not in a limiting sense.

It is also to be understood that the following claims are intended to cover all of the generic and specific features of the invention herein described and all statements of the scope of the invention which as a matter of language, might be said to fall therebetween.

Having described my invention, what I claim as new and desire to secure by Letters Patent is:

1. A combination lock constructed for ease of use, while also substantially eliminating the ability of unauthorized persons from opening the lock without knowledge of the combination, said combination lock comprising:

a housing incorporating
- an elongated bore,
- a plurality of dial receiving zones formed in the housing, each of said receiving zones
  - extending substantially perpendicularly to the axis of the central bore, and
  - defined by two juxtaposed, spaced, parallel facing surfaces, each of said surfaces extending perpendicularly to the central axis of the central bore; and
- an elongated release channel formed in the central bore and axially extending therewith, said elongated release channel defining a zone for enabling the opening of the combination lock;

a shackle comprising a generally J-shape, incorporating
- a short leg having a terminating end constructed for cooperative locking and unlocking interengagement with the housing, and
- a long leg cooperatively mounted in the elongated central bore of the housing for axial movement and pivoting movement relative thereto;

a plurality of tumbler sleeves, each of said tumbler sleeves
- rotationally mounted to the long leg of the shackle for rotational movement about the central axis thereof, and
- incorporating a radially extending fin formed on the outside surface thereof and constructed for cooperative association with the elongated release channel and the parallel, facing surfaces of the dial-receiving zone for preventing axial movement of the long leg of the shackle as well as enabling axial movement thereof when each of said radial fins are positioned in the elongated release channel;

a plurality of dials each of said dials
mounted in a dial receiving zone of the housing,
peripherally surrounding a tumbler sleeve for cooperating therewith, and
comprising an inside surface formed by-a tumbler locking surface and a rambler release surface; and a plurality of slots formed on one of said parallel, facing surfaces of the dial receiving zone for cooperating with the release channel and the radially extending fin of each tumbler sleeve, and constructed for providing a sound simulating the sound produced when the fin of a tumbler is positioned in the release channel;

whereby a combination lock construction is attained which is quickly and easily assembled with a minimum number of components and provides a highly effective combination lock which produces false rambler position sounds, thereby affording the ability of unauthorized persons to open the lock construction without knowledge of the specific combination.

2. The combination lock defined in claim 1, wherein said elongated bore comprises three separate and distinct zones, formed by a lowermost zone, a central zone and an uppermost zone, with each zone comprising different diameters with the lowermost zone comprising the smallest diameter and the uppermost zone comprising the largest diameter.

3. The combination lock defined in claim 2, wherein the dial is further defined as comprising a generally cylindrical shape having a plurality of indicia bearing panels on an outer surface thereof for establishing readily identifiable indicia which define elements usable as the combination for defining the release mode of the lock.

4. The combination lock defined in claim 3, wherein each of said dials is further defined as comprising a slot formed on the outer surface thereof between each adjacent indicia bearing panel.

5. The combination lock defined in claim 4, wherein said housing is further defined as comprising a cavity directly adjacent each dial receiving zone and the combination lock is further defined as comprising a spring and pin member mounted in each cavity for cooperating interengagement with each dial, providing a positive indicator for designating the position of the rotating dial and indicating when each panel is in a desired orientation for designating an element of the combination.

6. The combination lock defined in claim 2, wherein each of said tumbler sleeves is further defined as being mounted to the long leg of the shackle for rotational movement about the axis of the shackle while being essentially incapable of translational movement along the axis of the long leg of the shackle.

7. A combination lock constructed for ease of use, while also substantially eliminating the ability of unauthorized persons from opening the lock without knowledge of the combination, said combination lock comprising:

a housing incorporating
an elongated bore,
a plurality of dial receiving zones formed in the housing, each of said receiving zones
extending substantially perpendicularly to the axis of the central bore, and
defined by two juxtaposed, spaced, parallel facing surfaces, each of said surfaces extending perpendicularly to the central axis of the central bore; and
an elongated release channel formed in the central bore and axially extending therewith, said elongated release channel defining a zone for enabling the opening of the combination lock;

a shackle comprising a generally J-shape, incorporating
a short leg having a terminating end constructed for cooperative locking and unlocking interengagement with the housing,
a long leg cooperatively mounted in the elongated central bore of the housing for axial movement and pivoting movement relative thereto, and
a locking ring receiving slot and two radially extending protrusions formed on an outer surface of the long leg thereof in juxtaposed, spaced, aligned, axial relationship to each other, said slot and one of said protrusions defining a fixed axial length for said long leg;

a plurality of tumbler sleeves, each of said tumbler sleeves
rotationally mounted to the long leg of the shackle for rotational movement about the central axis thereof while being essentially incapable of translational movement along the axis of the long leg of the shackle, and
incorporating a radially extending fin formed on the outside surface thereof and constructed for cooperative association with the elongated release channel and the parallel, facing surfaces of the dial-receiving zone for preventing axial movement of the long leg of the shackle as well as enabling axial movement thereof when each of said radial fins are positioned in the elongated release channel;

a plurality of dials each of said dials
mounted in a dial receiving zone of the housing,
peripherally surrounding a tumbler sleeve for cooperating therewith, and
comprising an inside surface formed by a tumbler locking surface and a tumbler release surface;

a plurality of slots formed on one of said parallel, facing surfaces of the dial receiving zone for cooperating with the release channel and the radially extending fin of each tumbler sleeve, and constructed for providing a sound simulating the sound produced when the fin of a tumbler is positioned in the release channel; and a washer, a spacer, and a locking ring, each of which are constructed for cooperating with the plurality of tumbler sleeves mounted to the long leg of the shackle for defining an overall length substantially equivalent to the axial length established between the protrusion and the slot, whereby rotation of each tumbler sleeve is provided, while eliminating axial translational movement thereof;

whereby a combination lock construction is attained which is quickly and easily assembled with a minimum number of components and provides a highly effective combination lock which produces false tumbler position sounds, thereby affording the ability of unauthorized persons to open the lock construction without knowledge of the specific combination.

8. A combination lock constructed for ease of use, while also substantially eliminating the ability of unauthorized persons from opening the lock without knowledge of the combination, said combination lock comprising:

a housing incorporating
an elongated bore,
a plurality of dial receiving zones formed in the housing, each of said receiving zones
extending substantially perpendicularly to the axis of the central bore, and
defined by two juxtaposed, spaced, parallel facing surfaces, each of said surfaces extending perpendicularly to the central axis of the central bore; and
an elongated release channel formed in the central bore and axially extending therewith, said elongated release channel defining a zone for enabling the opening of the combination lock;

a shackle comprising a generally J-shape, incorporating a short leg having a terminating end constructed for cooperative locking and unlocking interengagement with the housing, and a long leg cooperatively mounted in the elongated central bore of the housing for axial movement and pivoting movement relative thereto;

a plurality of tumbler sleeves, each of said tumbler sleeves rotationally mounted to the long leg of the shackle for rotational movement about the central axis thereof while being essentially incapable of translational movement along the axis of the long leg of the shackle, and incorporating a radially extending fin formed on the outside surface thereof and constructed for cooperative association with the elongated release channel and the parallel, facing surfaces of the dial-receiving zone for preventing axial movement of the long leg of the shackle as well as enabling axial movement thereof when each of said radial fins are positioned in the elongated release channel;

a plurality of dials each of said dials mounted in a dial receiving zone of the housing, peripherally surrounding a tumbler sleeve for cooperating therewith, and comprising an inside surface formed by a tumbler locking surface and a tumbler release surface;

a plurality of slots formed on one of said parallel, facing surfaces of the dial receiving zone for cooperating with the release channel and the radially extending fin of each tumbler sleeve, and constructed for providing a sound simulating the sound produced when the fin of a tumbler is positioned in the release channel; and a sealing cap mounted in an open end of the elongated bore and constructed for effectively closing the bore with the tumbler sleeves mounted therein, preventing entry of any contamination into said bore.

9. The combination lock defined in claim 8, wherein said sealing cap is further defined as having a diameter substantially equivalent to the largest diameter zone of the elongated bore for enabling the sealing cap to be forced under pressure into said bore, thereby effectively sealing the bore.

10. The combination lock defined in claim 9, wherein said sealing cap is further defined as comprising a substantially circular shaped aperture, having a diameter slightly greater than the diameter of the shackle and two diametrically opposed radially extending slots constructed for cooperating with the protrusions formed on the outer surface of the shackle, thereby defining two entry zones for controlling the axial movement of the shackle relative to the sealing cap.

11. The combination lock defined in claim 10, wherein said sealing cap is further defined as comprising an internal ledge formed below the aperture and the radial slots for cooperating with the protrusions of the shackle for controlling the axial movement of the shackle relative thereto.

12. The combination lock defined in claim 1, wherein the tumbler locking surface of each dial is further defined as comprising a plurality of radial slots formed therein constructed for cooperating interengagement with the radially extending fin of the tumbler sleeve to assure secure, controlled, cooperative interengagement therewith and simultaneous rotation of the tumbler sleeve with the dial when the fin of the tumbler sleeve is engaged with any radial slot of the dial.

13. A combination lock constructed for ease of use, while also substantially eliminating the ability of unauthorized persons from opening the lock without knowledge of the combination, said combination lock comprising:

a housing incorporating an elongated bore, a plurality of dial receiving zones formed in the housing, each of said receiving zones extending substantially perpendicularly to the axis of the central bore, and defined by two juxtaposed, spaced, parallel facing surfaces, each of said surfaces extending perpendicularly to the central axis of the central bore; and an elongated release channel formed in the central bore and axially extending therewith, said elongated release channel defining a zone for enabling the opening of the combination lock;

a shackle comprising a generally J-shape, incorporating a short leg having a terminating end constructed for cooperative locking and unlocking interengagement with the housing, and a long leg cooperatively mounted in the elongated central bore of the housing for axial movement and pivoting movement relative thereto;

a plurality of tumbler sleeves, each of said tumbler sleeves rotationally mounted to the long leg of the shackle for rotational movement about the central axis thereof while being essentially incapable of translational movement along the axis of the long leg of the shackle, and incorporating a radially extending fin formed on the outside surface thereof constructed for cooperative association with the elongated release channel and the parallel, facing surfaces of the dial-receiving zone for preventing axial movement of the long leg of the shackle as well as enabling axial movement thereof when each of said radial fins are positioned in the elongated release channel, and comprising a longitudinal dimension substantially equivalent to the longitudinal width of the dial, thereby assuring interengagement of the radially extending fin and a radial slot of the dial when the combination lock is in the secured and locked position, thereby providing the ability of both the dial and the tumbler sleeve to freely rotate relative to the axis of the long leg of the shackle;

a plurality of dials each of said dials mounted in a dial receiving zone of the housing, peripherally surrounding a tumbler sleeve for cooperating therewith, and comprising an inside surface formed by a tumbler locking surface and a tumbler release surface, with the tumbler locking surface of each dial comprising a plurality of radial slots formed therein constructed for cooperating interengagement with the radially extending fin of the tumbler sleeve to assure secure, controlled, cooperative interengagement therewith and simultaneous rotation of the tumbler sleeve with the dial when the fin of the tumbler sleeve is engaged with any radial slot of the dial;

a plurality of slots formed on one of said parallel, facing surfaces of the dial receiving zone for cooperating with the release channel and the radially extending fin of each tumbler sleeve, and constructed for providing a sound simulating the sound produced when the fin of a tumbler is positioned in the release channel;

whereby a combination lock construction is attained which is quickly and easily assembled with a minimum number of components and provides a highly effective combination lock which produces false tumbler position sounds, thereby affording the ability of unauthorized persons to open the lock construction without knowledge of the specific combination.

14. The combination lock defined in claim 13, wherein the long leg of the shackle, with the plurality of tumbler sleeves mounted thereto and positioned in the elongated release channel, is capable of axial movement within the elongated bore relative to the plurality of dials to effectively remove the radially extending fin of the tumbler sleeves from cooperating interengagement with the tumbler locking surface of the dial, thereby enabling the dial to rotate about the axis of the shackle independently of the tumbler sleeves, allowing any desired indicia bearing panel of the dials to be positioned for selecting desired elements to define the release combination.

15. The combination lock defined in claim 1, wherein said plurality of slots are further defined as being formed on the upper surface of said two juxtaposed, spaced, parallel, facing surfaces peripherally surrounding the central bore in axially spaced locations relative to the release channel.

16. The combination lock defined in claim 15, wherein three slots are formed on the upper surface and positioned at an arcuate distance 90° from an adjacent slot.

17. A combination lock constructed for ease of use, while also substantially eliminating the ability of unauthorized persons from opening the lock without knowledge of the combination, said combination lock comprising:

a housing incorporating an elongated bore having one open end;

a plurality of dial receiving zones formed in the housing, each of said receiving zones extending substantially perpendicularly to the axis of the central bore, and defined by two juxtaposed, spaced, parallel facing surfaces, each of said surfaces extending perpendicularly to the central axis of the central bore; and an elongated release channel formed in the central bore and axially extending therewith, said elongated release channel defining a zone for enabling the opening of the combination lock;

a shackle comprising a generally J-shape, incorporating a short leg having a terminating end constructed for cooperative locking and unlocking interengagement with the housing, and a long leg cooperatively mounted in the elongated central bore of the housing for axial movement and pivoting movement relative thereto and comprising at least one protrusion formed on the outside surface thereof;

a plurality of tumbler sleeves, each of said tumbler sleeves rotationally mounted to the long leg of the shackle for rotational movement about the central axis thereof, and incorporating a radially extending fin formed on the outside surface thereof and constructed for cooperative association with the elongated release channel and the parallel, facing surfaces of the dial-receiving zone for preventing axial movement of the long leg of the shackle as well as enabling axial movement thereof when each of said radial fins are positioned in the elongated release channel;

a plurality of dials each of said dials mounted in a dial receiving zone of the housing, peripherally surrounding a tumbler sleeve for cooperating therewith, and comprising an inside surface formed by a tumbler locking surface and a tumbler release surface; and a separate and independent sealing cap mounted in the open end of the elongated bore and incorporating a substantially circular shaped aperture formed therein, having a diameter slightly greater than the diameter of the shackle, and two-radially diametrically opposed radially extending slots constructed for cooperating with the protrusion formed on the outer surface of the shackle, for receiving and retaining the long leg of the shackle in peripheral surrounding axially removable engagement therewith, sealing the bore and the components mounted therein while enabling the shackle to be axially movable;

whereby a combination lock construction is attained which is quickly and easily assembled with a minimum number of components and provides a highly effective combination lock which prevents entry of unwanted contamination into the bore and the operating components therein.

18. The combination lock defined in claim 17 and further comprising a plurality of slots formed on one of said parallel, facing surfaces of the dial receiving zone for cooperating with the release channel and the radially extending fin of each tumbler sleeve, and constructed for providing a sound simulating the sound produced when the free of a tumbler is positioned in the release channel.

19. The combination lock defined in claim 18, wherein said plurality of slots are further defined as being formed on the upper surface of said two juxtaposed, spaced, parallel, facing surfaces peripherally surrounding the central bore in axially spaced locations relative to the release channel.

* * * * *